US006204836B1

(12) United States Patent
Yamazaki et al.

(10) Patent No.: US 6,204,836 B1
(45) Date of Patent: Mar. 20, 2001

(54) DISPLAY DEVICE HAVING DEFECT INSPECTION CIRCUIT

(75) Inventors: Tsuneo Yamazaki; Kunihiro Takahashi; Hiroaki Takasu; Atsushi Sakurai, all of Tokyo (JP)

(73) Assignee: Seiko Instruments INC (JP)

( * ) Notice: Subject to any disclaimer, the term of this patent is extended or adjusted under 35 U.S.C. 154(b) by 0 days.

(21) Appl. No.: 08/239,730

(22) Filed: May 9, 1994

(30) Foreign Application Priority Data

May 12, 1993 (JP) ..... 5-110671

(51) Int. Cl.[7] ..... G09G 3/36
(52) U.S. Cl. ..... 345/98
(58) Field of Search ..... 345/93, 98, 100, 345/904

(56) References Cited

U.S. PATENT DOCUMENTS 4,676,761 6/1987 Poujois .
5,262,720 11/1993 Senn et al. .

FOREIGN PATENT DOCUMENTS 0143039 5/1985 (EP) .
0480819 4/1992 (EP) .
9211560 7/1992 (WO) .

OTHER PUBLICATIONS

IEEE Journal of Solid–State Circuits, vol. 25, No. 2, Apr. 25, 1990, New York, pp. 531–538, I. De Rycke et al., "2–MHz clocked LCD Drivers on Glass".

*Primary Examiner*—Jeffery Brier
(74) *Attorney, Agent, or Firm*—Adams & Wilks

(57) ABSTRACT

A dense display may be provided with an internal defect detection circuit to enhance production yield. A plurality of pixels, each including thin film transistors and liquid crystal cells driven by driving electrodes, are arranged in a matrix form and scanned by a plurality of control signal lines and a plurality of image signal lines. A control signal line driving circuit is formed of shift registers having one bit per signal line, and sample-and-hold circuits. An inspection circuit is provided with plural switching elements, each having a first terminal connected to a respective image signal line, a second terminal connected to an inspection output line and a third terminal receptive of an inspection control input signal for controlling an electrical connection between the first and second terminals. In accordance with this configuration, inspection of individual signal lines may be achieved and the inspection control input signal may be internally or externally generated. Moreover, similar detection circuitry may be used to detect defects in the control signal lines and, in this manner, defects may be located to the individual pixel level.

9 Claims, 6 Drawing Sheets

DISPLAY DEVICE HAVING DEFECT INSPECTION CIRCUIT

BACKGROUND OF THE INVENTION

This invention relates to inspection circuits of flat type light valve devices used for direct visual type display devices or projection type display devices. More specifically, it relates to light valve devices, and for example, inspection circuits of active-matrix liquid crystal display devices which incorporate integrated circuits, such as a liquid crystal panel formed of driving circuits unitarily into semiconductor thin films.

An active-matrix type liquid crystal display device has an extremely simplified operation principle, where switching elements are provided on each pixel, and in selecting specified pixels the corresponding switching elements are activated, and in a non-selecting state, the switching elements are deactivated. The switching elements are formed on a glass substrate constituting a liquid crystal panel, and it is therefore important to realize a method for more satisfactorily producing thin-film switching elements. For such elements, thin-film type transistors are generally used.

The conventional active-matrix device shown in a schematic circuit diagram in FIG. 6, comprises; pixels each arranged in a matrix shape in vertical and horizontal directions and formed of thin-film transistors 1 and electrooptic elements 3 such as liquid crystal elements, control signal lines 5 provided on gate electrodes of the thin film transistors 1, image signal lines 4 connected to source electrodes, an image signal line driving circuit 8 connected to the image signal lines 4, and a control signal line driving circuit 6 connected to control signal lines 5. The control signal line driving circuit 6 is mainly formed of shift registers, where each unit-bit output is connected to the signal lines 5. The image signal line driving circuit 8 is formed of the shift registers and sample hold circuits provided at every bit basis, and writes the image signals into the sample hold circuits in accordance with sampling signals from output of the shift registers.

The conventional light valve device has more than several hundreds of adjacent pixels arranged respectively in each of the vertical and horizontal directions, the quantity of pixels thus reaches an extent of one million and generally at least an area of more than 1 cm2. It is considerably difficult to produce such elements with a high production yield without any defect, and in general the produced elements are inspected in a form of the driving substrate before completion as a light valve device. For the most normal method of inspection, the measurement to determine acceptance or failure is performed in accordance with the current produced by applying a voltage through a metallic probe (hereinafter referred to as a prober) in contact with the electrodes of elements, or for the output voltage/current etc.

In the method described above, to confirm operation of the elements formed of a large number of pixels of the light valve devices or the like more than several hundreds of probers are required to be in electrical contact with the electrodes of elements at an interval corresponding to a pitch between pixels, and it is therefore difficult to obtain a reliable result in using the present technique. On the other hand, while measurement may be performed while moving a smaller number of probers, this however requires a long time for the measurement process and is not suitable for practical use.

For another method of inspection, it is considered by applicants to provide inspection circuits inside the elements.

FIG. 6 shows an equivalent circuit diagram of the elements used in such inspection method, where transistors 23 having gate electrodes connected to the signal lines 4 are provided on signal output sections ranging from each driving circuit to the pixels, and in the inspection transistors 23 one-side terminals 24 are grounded and the other-side terminals are connected to common terminals 25 thereafter connected to a power supply 27 through a load resistance 26, such that an output of the load is then detected by the inspection transistors 23 at every bit. Signals from the driving circuit are applied to the signal lines 4 to turn ON the inspection transistors 23 and to produce current flow into the load 26, and with such current flow detected, the signal transfer to the signal lines 5 is confirmed. By observing timing of the current flow in synchronism with clock of the shift register, a bit relating to the operation can be determined to thereby detect a line on which a malfunction arises.

However, in the inspection circuit of the light valve device, if only one of the detecting FET's having several hundreds of bits comes to a turn-ON state, signals are detected in an output of a buffer amplifier, thus the inspection circuit of the light valve device does not determine on which of the bits the defect is generated in the case of the driving method of simultaneously originating signals for a plurality of bits. The image signal driving circuit generally produces the outputs at the same time from the entire lines. The present invention, which provides a function to control detecting operation at every bit basis, securely performs the detecting operation only at specified bits to exactly find a cause of the defect. With the malfunction securely determined, the defective components or parts are removed in the form of driving substrate, at the same time the cause of malfunction is fed back and thus reduces generation of such malfunction. The present invention also uses an electrical method, which enables rapid measurement.

SUMMARY OF THE INVENTION

To solve the problem above described, an inspection circuit for a light valve device according to the present invention is provided in a light valve device which is comprised of; a driving substrate which includes, driving electrodes arranged in a matrix form, switching elements for driving the driving electrodes, pixels formed of electrooptic material driven by the switching elements, and a driving circuit for driving and exciting control signal lines and image signal lines depending on predetermined signals, both the control signal lines for controlling turn ON/OFF of each switching element and the image signal lines for transferring image display signals being connected to the switching elements; a counter substrate opposingly arranged on the driving substrate; and an electrooptic material layer arranged between the driving substrate and the counter substrate. The inspection circuit for the above-described light valve comprises a driving circuit operation confirmation circuit in which the signal lines are connected with switching devices formed of three terminals, a first terminal of the three terminal elements is connected to signal lines, a second terminal is connected to inspection signal output line, and a third terminal is a terminal for controlling connection/disconnection of the first terminal and the second terminal.

Switching elements capable of performing connection/disconnection of input from signal lines to detectors are provided to detect signal levels of the signal lines during input or after completion of the input. In addition, the timing of signal potential detection of the signal lines is controlled to independently detect each operation of the entire signal lines.

DETAILED DESCRIPTION OF THE PREFERRED EMBODIMENTS

Figure 1:
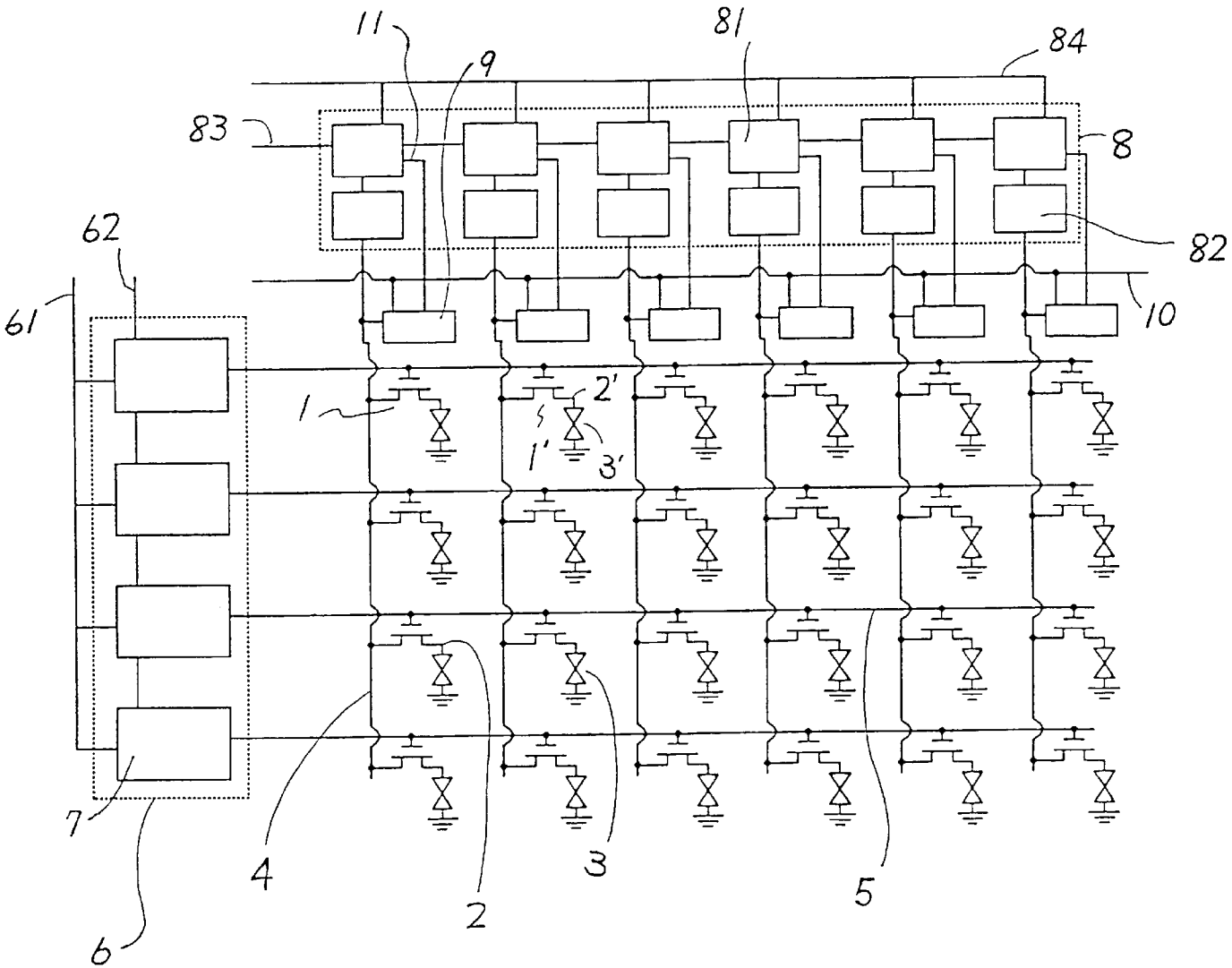
FIG. 1 shows one embodiment of an inspection circuit of the present invention.

FIG. 1 is a circuit diagram showing an embodiment of the present invention. In the drawing, a plurality of pixels includes switching elements 1 made of thin-film type transistors and corresponding liquid crystal cells 3 formed of an electrooptic material driven by liquid crystal driving electrodes 2 connected to drain electrodes of the thin-film type transistors, are arranged in a matrix shape having rows and columns, one image signal line 4 is connected to a source of each pixel transistor on each individual column, and one control signal line 5 is connected to a gate electrode of each pixel transistor on each individual row. A control signal line driving circuit 6 is formed of shift registers having one bit per signal line, wherein data signals inputted into a data input line 62 on scanning-start, synchronized with a clock signal of a control signal clock input line 61, output the signals capable of turning ON the thin-film transistor 3 gate to the corresponding control signal line 5 from a shift register whose position is moved by one bit per clock cycle.

An image signal line driving circuit 8 is formed of shift registers 81 having the bit number corresponding to the number of columns of pixels, and sample hold circuits 82 connected to the shift registers of each bit. As in the control signal line driving circuit, outputs from the shift registers feed image-signal sampling signals to the sample hold circuits 82 while moving by one bit per every clock by clock signals of a clock signal input line 84, thus image signals from an image signal input line 83 are held in the sample hold circuits. Outputs of the sample hold circuits are output to the image signal lines 4 through amplifiers, etc. Detecting circuits 9 having three terminals, where the first terminals are connected to the image signal lines 4, and the outputs of the sample-and-hold circuits 82 the second terminals are connected to, output line 10, and the third terminals are connected to outputs 11 of the shift registers 81.

When outputs of the shift registers is high "H", synchronously thereto the image signals come to an ON-state, and feed signals now being applied to the image signal lines 4 to the output line 10. That is, the output of the inspection signal output line 10, only when a shift register of a specified bit is "H", detects and outputs the image output corresponding to such bit. In the shift registers, only one bit outputs "H" at one time, thus even when inputs from a plurality of bits exist in parallel each other in the output buffer, then only the image output of specified bit can be detected in specified timing, this therefore results in detecting each image output of a plurality of bits independently.

Figure 2:
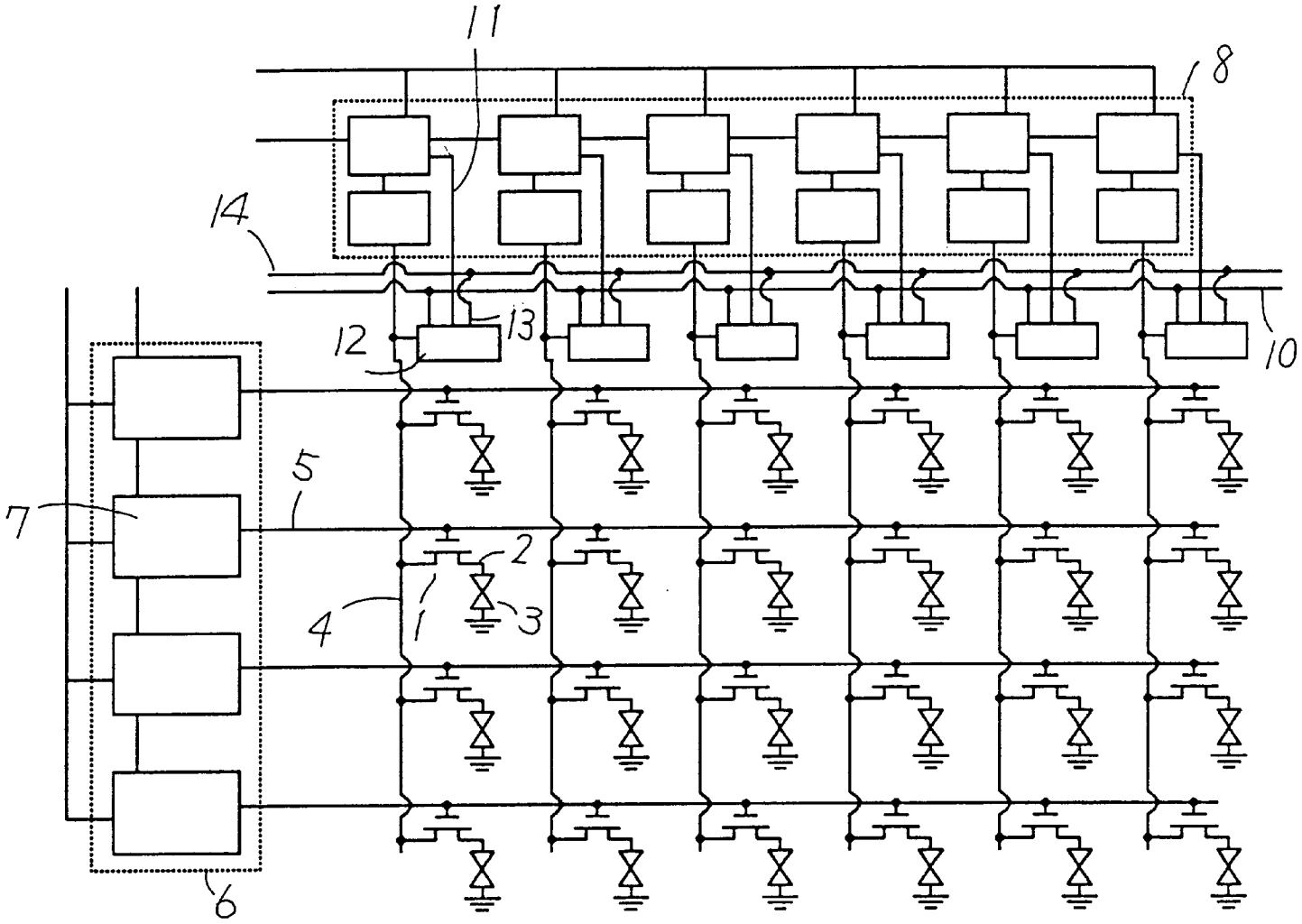
FIG. 2 shows another embodiment of an inspection circuit of the present invention.

FIG. 2 shows another embodiment of a detecting circuit according to the invention, where an input of a detecting circuit 12 to a detecting control signal terminal 13 differs from FIG. 1, signals of the input terminals 11 and 13 pass through a logic product circuit, thereafter in accordance with the logic product value, it is determined whether or not an output to the terminal 10 is performed. When a detecting control signal is "L", the control proceeds in that no detecting is performed, and even when output signals of the adjacent bits of the shift register are overlapped in timing, then the output from the specified bit can be detected by designating the detecting timing using detecting control signals. Otherwise, the timing overlap with the adjacent bit is prevented by adding the shift-register inverted signal of an adjacent bit to the detecting control signal.

Figure 3:
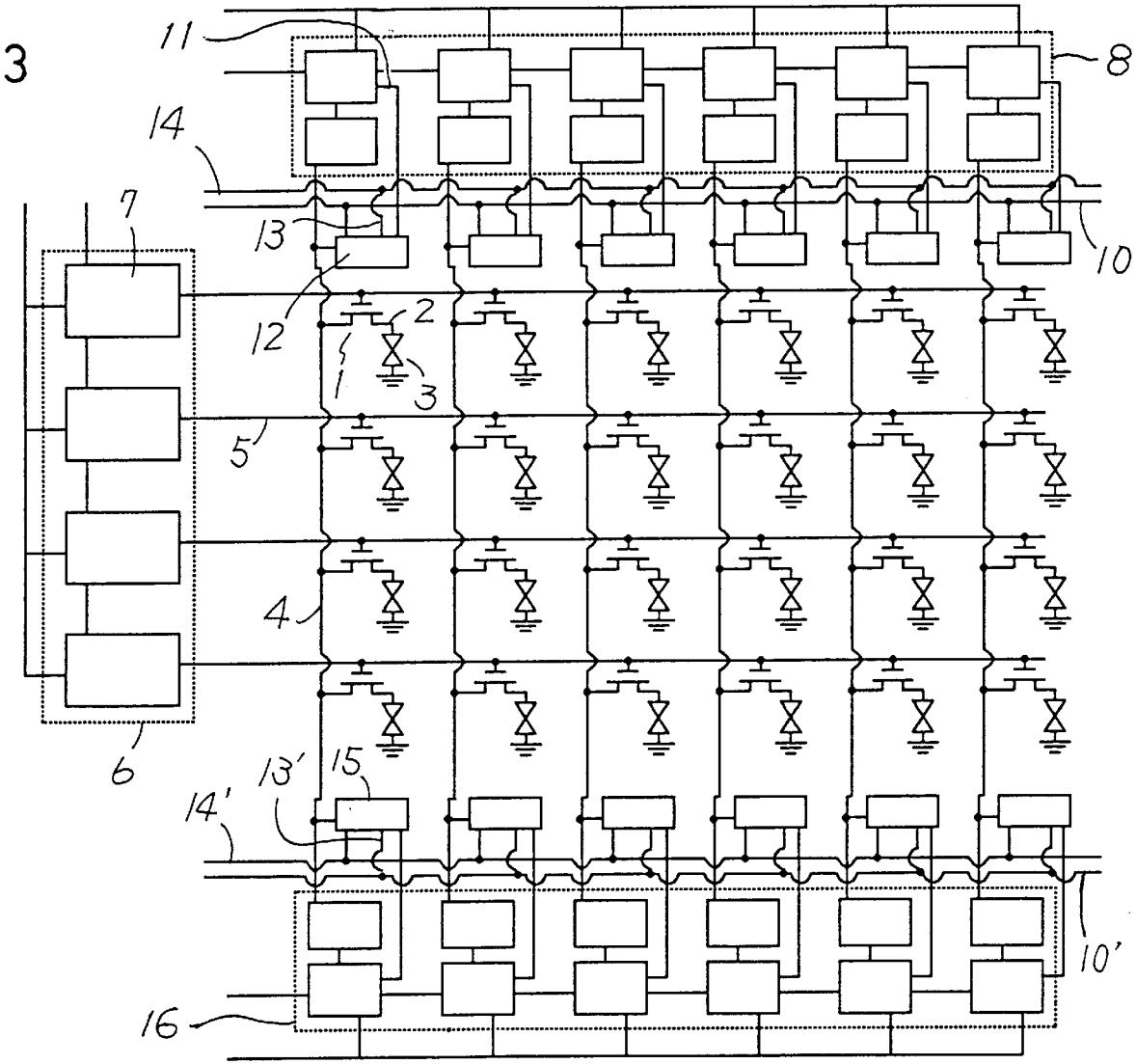
FIG. 3 shows another embodiment of an inspection circuit of the present invention.
Figure 4:
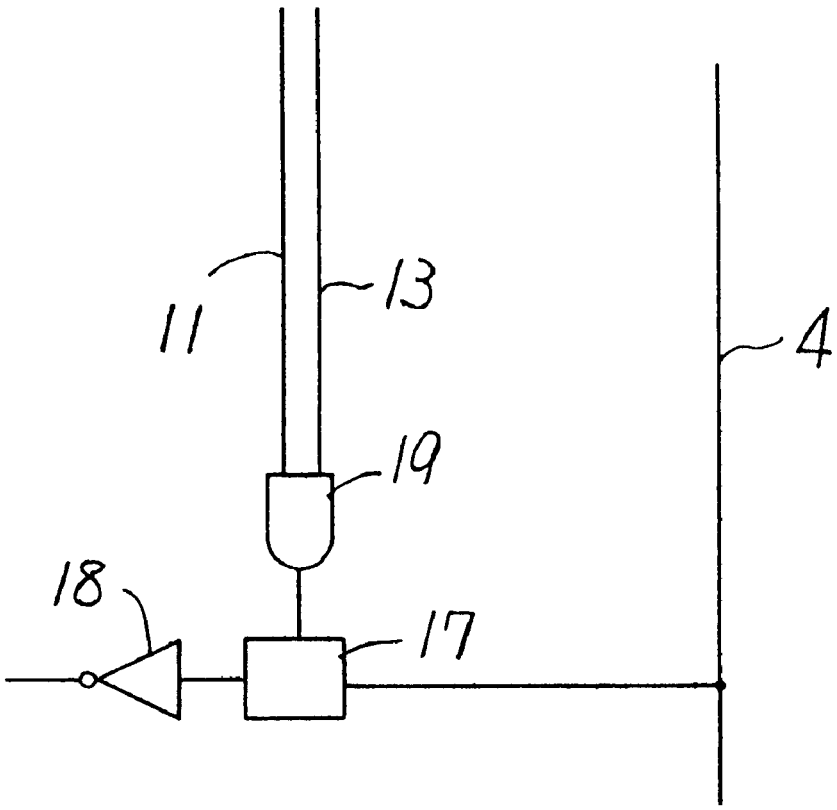
FIG. 4 shows one embodiment of a circuit of detecting section of an inspection circuit of the present invention.

FIG. 3 shows a detecting circuit of a light valve device showing another embodiment of the present invention. In FIG. 3, the signal detecting circuit 12 and a signal detecting circuit 15 are provided on both ends of the image region of the image signal line 4 respectively. A driving circuit 16 for scanning a second detecting circuit 15 is also provided independently from a first driving circuit 8. In the first and second driving circuits, two methods are employed, namely, the shift clocks thereof are synchronized, or respectively independent shift clocks are used. The detecting circuits 12 and 15 provided on both ends of the signal line enable to detect signal line defect such as disconnection of the signal line etc. Specifically, when signals are detected by the first detecting elements and not detected by the second detecting elements, disconnection is determined to exist intermediate the signal line. The detecting circuit as shown in FIG. 4, can readily be formed of a transmission gate 17 and an amplifier 18 and the like. An input 11 and a detecting control signal 14 of the shift register are fed through a logic product circuit 19 to be input into the transmission gate.

Figure 5:
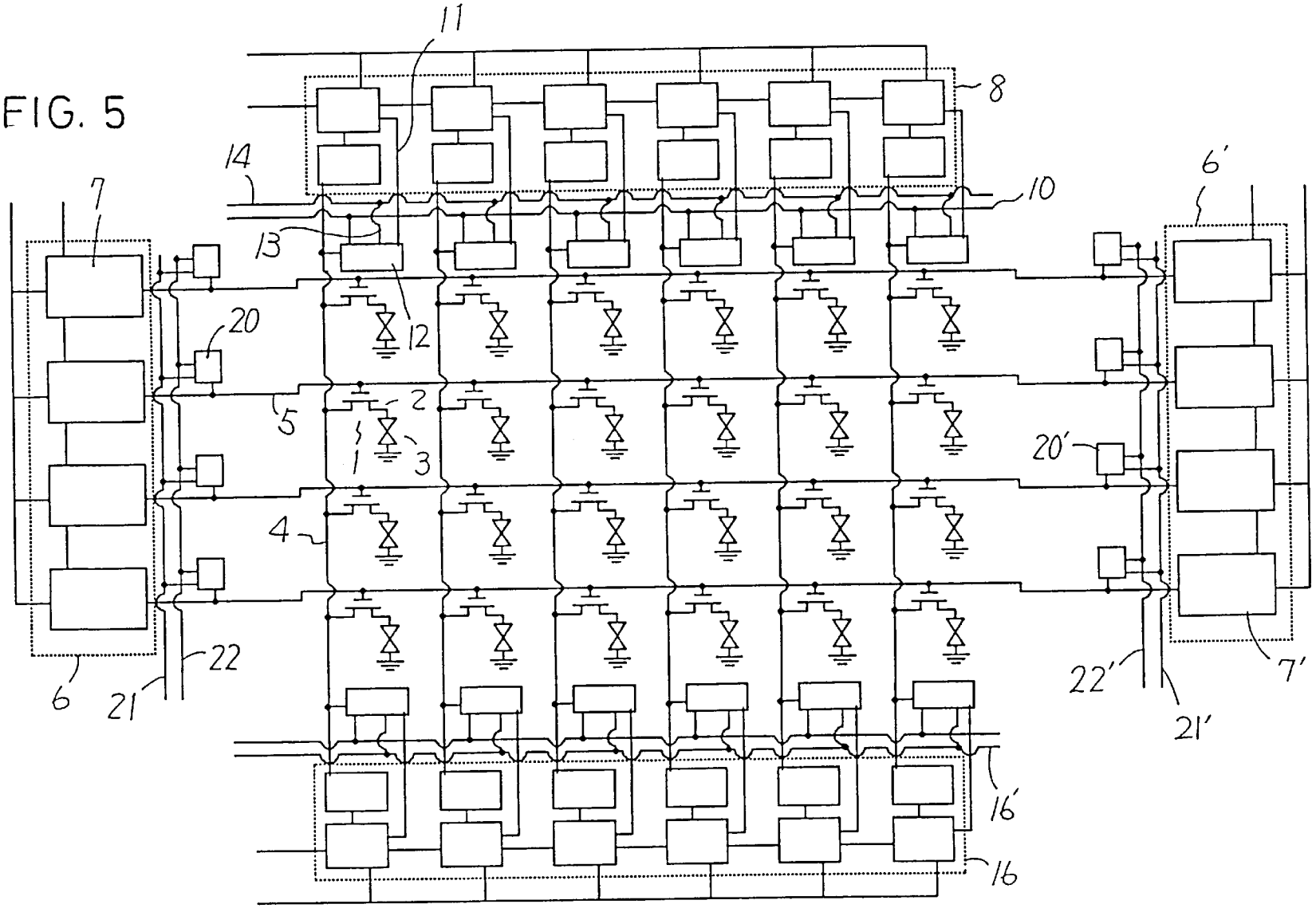
FIG. 5 shows another embodiment of an inspection circuit of the present invention.
Figure 6:
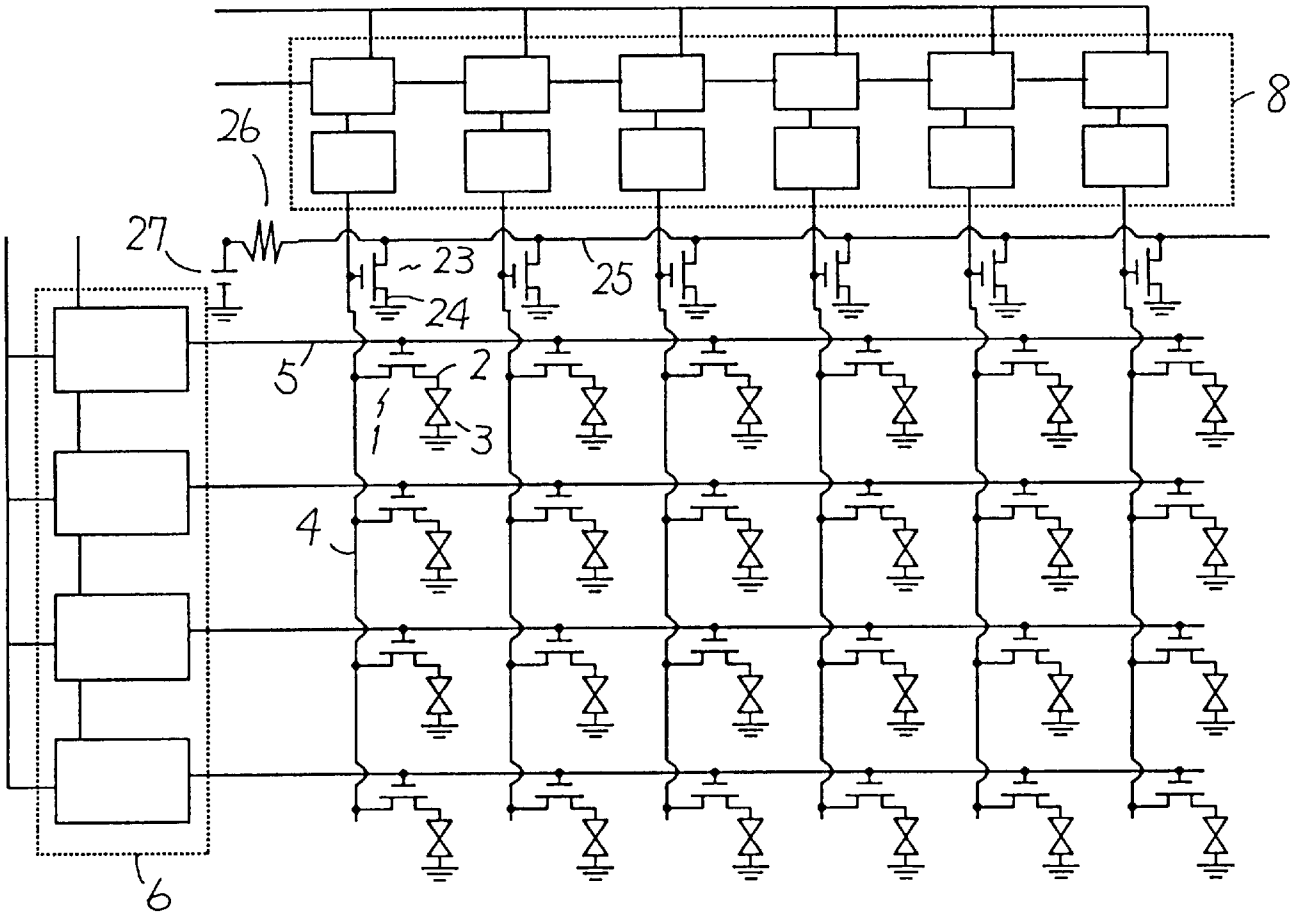
FIG. 6 PRIOR ART
FIG. 6 is a schematic circuit diagram example of the conventional active-matrix type liquid crystal display panel.

FIG. 5 shows another embodiment of the present invention, where an inspection circuit is also provided on both-sides of a control signal line. The control lines 5 are connected to detecting-signal input terminals of detecting circuits 20 and 20', the connections of inspection output terminals 21 and 21' and signal detecting control terminals 22 and 22' are similar those of the detecting circuits 12 and 15.

According to the invention, in observing an inspection signal output there can independently be made for all the signal lines a decision as "normal" if possible to detect output signals to images by a specified timing, and as "malfunction" if impossible to detecting the same. In addition, the inspection circuit is incorporated in the element to enable inspection without using the prober etc. When the detecting circuit is provided on both-ends of the signal line, either of the driving circuit or the image region is determined as a position where a malfunction arises, this improves production yield in coping with the cause of the malfunction on production process. The inspection can be performed in an extent of the time corresponding to displaying one image picture, possibly within several tens of milli-seconds.

Furthermore, the detecting circuit connected to the image signal output line, if using analog input/output, determines whether or not the suitable image picture signal value is being obtained as an analog value, in addition to whether or not the signal is present. Moreover, if the control signal line is linked with the image picture signal line, it is determined whether satisfactory or not at every pixel basis, where, after writing image signals into the pixels, signals within the pixels are output to the image picture signal line as in DRAM to detect and amplify thus produced output by the detecting circuit, thereby it is determined whether or not the image picture signal is written and held into the pixels.

As hereinbefore fully described, according to the present invention, a circuit for detecting malfunction in operation is unitarily formed inside elements, failures of driving circuits and malfunctions pixels are detected together with positions of such malfunctions and failures by a compact size display device having the driving circuit formed on the same substrate. Further, remarkable effect is obtained in considerably reducing the measurement time.

What is claimed is:

1. A display device having a driving substrate, a counter substrate and an electro-optic material arranged between the driving substrate and the counter substrate, wherein the driving substrate comprises: a plurality of control signal lines for providing control signals; a plurality of image signal lines intersecting with the control signal lines for providing an image display signal; a plurality of pixels each comprising a switching element, a driving electrode electrically connected to the switching element and the electro-optic material, each pixel being located proximate a respective intersection of the control signal lines and the image signal lines; a driving circuit for driving the control signal lines and the image signal lines, the driving circuit comprising a control signal line driving circuit connected to the control signal lines and an image signal line driving circuit having a plurality of shift registers and sample-and-hold circuits connected to the image signal lines, wherein the shift registers provide sampling signals to the sample-and-hold circuits and respective sample-and-hold circuits provide the image signal to corresponding image signal lines; and a driving circuit confirmation circuit comprising a plurality of switching means and an inspection signal output line, each switching means having a first terminal electrically connected to one of the image signal lines, a second terminal electrically connected to the inspection signal output line, and a third terminal connected to an inspection control input signal for controlling an electrical connection between the first terminal and the second terminal so as to enable the detection of a defect in individual image signal lines by detecting the presence or absence of a signal on the inspection signal output line.

2. A display device according to claim 1; wherein the third terminal of each respective switching means is electrically connected to receive an inspection control output signal of a respective shift register of the image signal line driving circuit; and wherein the shift registers of the image signal line driving circuit are driven such that only one shift register provides an inspection control output signal at any given time.

3. A display device according to claim 1; wherein each respective switching means comprises a logic circuit electrically connected to receive an output of a respective shift register of the image signal line driving circuit and an inspection control input signal, and the display device includes means for selectively controlling the inspection control input signal to permit the continuity checking of individual image signal lines.

4. A display device according to claim 1; wherein the plurality of image signal lines and the plurality of control signal lines define an image region, the driving circuit and the driving circuit confirmation circuit are formed around the image region on the driving substrate, and each respective switching means of the driving circuit confirmation circuit includes a first switching element provided proximate a top end of the image region and a second switching element provided proximate a bottom end of the image region such that a defect may be detected to be between the respective first and second detection elements.

5. A display device according to claim 1; wherein the inspection control input signal is generated by the image signal line driving circuit.

6. A display device according to claim 1; further comprising external inspection controlling means for generating the inspection control input signal.

7. A display device having a driving substrate, a counter substrate and an electrooptic material arranged between the driving substrate and the counter substrate, wherein the driving substrate comprises; a plurality of signal lines for providing an image display signal; a plurality of pixels each comprising a switching element and a driving electrode electrically connected to the switching element and the electrooptic material; driving means for driving the signal lines, the driving means comprising a plurality of shift registers receptive of an input image signal and a plurality of sample-and-hold circuits each for receiving an output signal from a respective shirt register, each respective sample-and-hold circuit providing an output image signal to a respective signal line; and inspection means comprising a test element and an inspection signal output line, the test element having a first terminal connected to a signal line, a second terminal connected to the inspection signal output line, and a third terminal receptive of an inspection input signal for controlling the signal at the second terminal in accordance with the signal at the first input terminal and the inspection input signal such that inspection of individual signal lines may be performed.

8. A display device according to claim 7; wherein the signal lines comprise a plurality of control signal lines and a plurality of image signal lines intersecting the control signal lines, a respective pixel being located proximate each intersection of a control signal line and an image signal line; the driving means comprises control signal driving means and image signal driving means; and the inspection means comprises a control signal line inspection means having a plurality of test elements each having a respective first terminal connected to a respective control signal line, and image signal line test means having a plurality of test elements each having a respective first terminal connected to a respective image signal line such that a defect in a respective pixel may be determined.

9. A display device according to claim 7; wherein the plurality of signal lines comprises a plurality of control signal lines and a plurality of image signal lines to define an image region, and each respective test element comprises a first test element provided proximate one end of the image region and a second test element provided proximate an opposite end of the image region such that a defect in a respective one of the control signal lines and image signal lines may be detected to be between the first and second test element.

* * * * *